United States Patent [19]

Cassese et al.

[11] Patent Number: 4,546,908

[45] Date of Patent: Oct. 15, 1985

[54] HORIZONTAL PAPER FORM POSITIONER AND ADJUSTING MECHANISM

[75] Inventors: Samuel E. Cassese, Northridge; Walter Marquez, Canoga Park, both of Calif.

[73] Assignee: Dataproducts Corporation, Woodland Hills, Calif.

[21] Appl. No.: 707,169

[22] Filed: Feb. 28, 1985

Related U.S. Application Data

[63] Continuation of Ser. No. 153,452, May 27, 1980, abandoned.

[51] Int. Cl.[4] ..... B65H 17/38

[52] U.S. Cl. ..... 226/74; 226/75

[58] Field of Search ..... 226/74, 75, 108, 111, 226/179

[56] References Cited

U.S. PATENT DOCUMENTS

| | | | |
|---|---|---|---|
| 3,006,520 | 10/1961 | House | 226/75 |
| 3,114,491 | 12/1963 | Wright | 226/75 |
| 3,154,235 | 10/1964 | Hubbard | 226/74 |
| 3,407,981 | 10/1968 | Staugaard | 226/74 X |
| 3,448,906 | 6/1969 | Walsh et al. | 226/75 |
| 3,578,138 | 5/1971 | Cantwell | 226/74 X |
| 3,721,377 | 3/1973 | Atkinson | 226/74 |

*Primary Examiner*—Stanley N. Gilreath

*Attorney, Agent, or Firm*—Spensley Horn Jubas & Lubitz

[57] ABSTRACT

A device for horizontally positioning and maintaining the horizontal tension on paper forms as they are transported through a printer. The device employs a single control knob to make all position adjustments to the paper tractors which grip the computer forms. The device utilizes a cable pulley system to position the paper tractors. The control knob has a first position in which adjustment of the tension on the paper form is facilitated and a second position which facilitates adjustment of the position of the paper form within the printer.

7 Claims, 4 Drawing Figures

HORIZONTAL PAPER FORM POSITIONER AND ADJUSTING MECHANISM

This is a continuation of copending application Ser. No. 153,452, filed on May 27, 1980, now abandoned.

BACKGROUND OF THE INVENTION

1. Field of the Invention

This invention relates to a device for positioning and maintaining horizontal tension on paper computer forms of varying width.

2. Description of Prior Art

In the field of computer peripherals, an important feature of high speed printers is the ability to accept paper computer forms of different widths and weights.

Conventional high speed printers utilize paper forms which have perforations along their edges. When the paper enters the printer, it comes in contact with two paper tractors which have small protrusions which engage the perforations. As the tractors turn, the paper is transported into the printer and past a printing mechanism.

In such printers, the positioning of the paper relative to the printing heads is critical if the printed output is to be properly centered on the paper. Therefore, it is important to maintain the paper tractors in the proper positions relative to the locations of the printing mechanism. An additional requirement is that the horizontal tension of the paper across the printing mechanism be maintained, thereby insuring a clean even print on the paper. These requirements are met by adjusting the positions of the tractors individually to achieve the proper separation for a particular width paper, and in tandem from side to side to accurately position the entire sheet of paper.

Traditionally, paper tractor positioning is achieved by positioning the tractors on a shaft and linking them mechanically so that they move in unison. This system does not accommodate paper forms of varying widths. Other systems which have been used have proven to be overly complex.

Some printers utilize two vertically aligned pairs of tractors to move the paper. These printers generally have no provision for realigning the upper and lower tractors if they fall out of vertical alignment relative to one another. In addition, most prior art methods require the major portion of horizontal tractor adjustment to be made by manually sliding or moving the tractors to a general location, and then fine adjusting the tractors to the final position by means of an additional knob or knobs. In addition to the above disadvantages, these systems employ a number of shafts, machined brackets and supports, so that they take up an unnessary amount of space and cannot be easily adapted to a modular design. Because of this the cost of manufacture and installation of most prior art systems has been fairly high.

It is one objective of the present invention to provide a paper form positioning and retaining apparatus which does not depend upon a complex series of shafts or plates for its adjustment. It is another objective of the present invention to provide an apparatus which may be quickly and easily adapted to accept paper forms of different widths, and to adjust the horizontal tension thereon, using a single control mechanism.

It is yet another objective of the present invention to provide an adjustment means for two pairs of vertically spaced tractors or tractor supports, wherein the vertical alignment of the tractors may be verified by recalibration to a base position without the need to disassemble the printer.

It is another objective of the present invention to provide a device which is modular in construction, easy to assemble, and low in cost.

SUMMARY OF THE INVENTION

The present invention meets these and other objectives by providing a mechanism that may be used to horizontally position paper forms of varying widths, and to provide a controlled horizontal tension adjustment thereon.

The mechanism includes a pair of parallel tractor shafts upon which four tractor supports are movably mounted, two on each tractor shaft. The actual tractor mechanisms are mounted on the tractor supports. The assembly could be designed so that the tractors are mounted directly to the tractor shafts, thus eliminating the need for separate tractor supports (i.e., the tractors can be either integral with or separate from the tractor supports). The tractor shafts are located above and below the printing mechanism, so as to provide a frame from which motion may be imparted to the paper. The position of each tractor support along the tractor shaft is controlled by a pulley and cable system. Affixed to each end of the shafts is a mounting block containing two tractor cable pulley wheels, one in each mounting block for each tractor support on that tractor shaft. A pulley cable is looped around each of the pulley wheels and stretched across the shafts. A turnbuckle attaches the ends of the cable to the tractor support and is used to adjust each cable to its proper tension. The rotation of the pulley wheels displaces the pulley cable and causes the tractor support to slide along the length of the tractor shaft.

In order to accurately position the paper form, it is necessary that the upper and lower tractors on either side be aligned to the same horizontal position. The tractor supports on either side of the upper and lower tractor shafts are kept in alignment by means of two belts connected between pulleys on the upper and lower shaft. Four belt pulley wheels associated with the two belts are positioned directly adjacent to each of four cable pulley wheels in the upper and lower right mounting blocks. Each of the four belt pulley wheels is individually fixed to one of the four cable pulley wheels which is associated with it. Thus, when an upper cable pulley is rotated, the lower cable pulley coupled to it by one of the belts is synchronously rotated, thereby linking the movements of the upper and lower tractors on each side.

The movement of the pulley arrangements attached to the four tractor supports is controlled by means of a single control knob which is axially displaceable into two functional positions. In one position, the knob is coupled to and controls the displacement of either the two right or two left tractor supports only, in order to adjust the spacing between the tractors. In another position, the knob is coupled to and controls the displacement of all four tractor supports simultaneously to control the position of the paper form in the printer. The control knob is coupled to the cable pulleys by a friction clutch assembly.

Although the system as designed uses four tractors which are driven to advance the perforated paper form across the printing heads, it is readily adaptable to a two-tractor system, simply by elimination of the two timing belts and the lower half of the device.

DETAILED DESCRIPTION OF THE DRAWINGS

Figure 1:
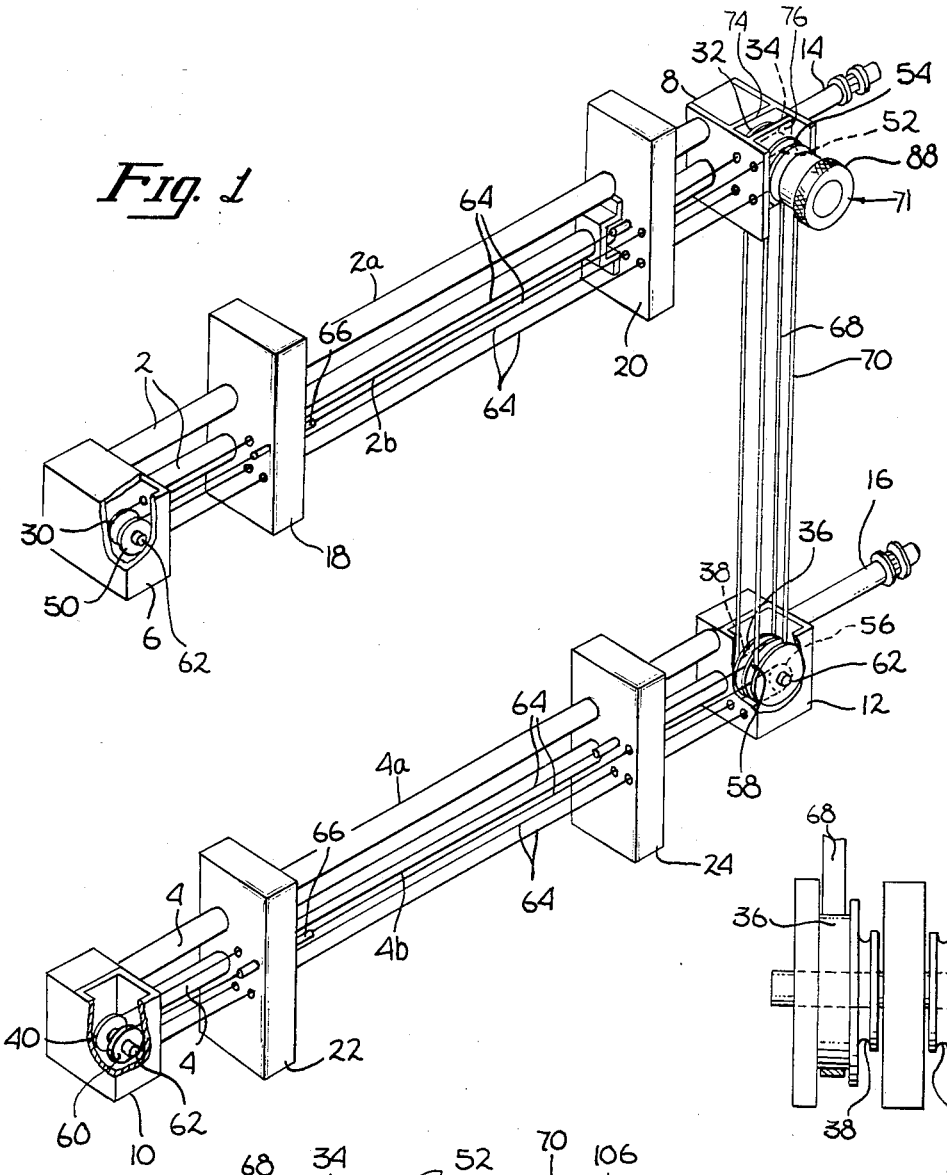
FIG. 1 is a perspective view of the horizontal paper positioning and tension adjusting mechanism.

FIG. 1 shows a perspective view of the horizontal paper positioning and tension adjusting mechanism. The mechanism is contructed on a frame comprising two pairs of horizontal tractor shafts 2*a* and 2*b*, and 4*a* and 4*b*. The top pair of tractor shafts 2*a* and 2*b* are held parallel to each other by a left mounting block 6 and a right mounting block 8. Similarly, the lower pair of tractor shafts 4*a* and 4*b* are also maintained in a parallel configuration by mounting blocks 10 and 12. The two pairs of tractor shafts 2*a* and 2*b*, 4*a* and 4*b* are also fixed parallel in relation to one another, such that each tractor shaft is parallel to the other three and they all lie in a common plane. The upper and lower pairs of tractor shafts are designed to be fixed to the chassis of a printer (not shown) by means of two mounting bar extensions 14 and 16. Printing is accomplished on a paper form (not shown) as it is transported between the upper and lower tractor shaft pairs.

Mounted upon the tractor shafts 2 and 4 are four horizonatally movable tractor supports 18, 20, 22 and 24. Paper tractors (not shown) used for transporting the paper are permanently mounted on the supports. The supports 18 and 20 and 22 and 24 are slidable along the length of the tractor shafts 2 and 4, respectively, so that the paper tractors may be positioned at the edges of paper forms of different widths.

Each of the tractor supports 18, 20, 22, and 24 is moved along the length of shafts 2 and 4 by means of a pulley arrangement. The pulley arrangement for the upper tractor supports includes two pulley wheels 30 and 50, which are rotatably mounted adjacent to each other in the upper left mounting block 6 on a pulley axle 62, two pulley wheels 34 and 52 which are rotatably mounted adjacent to each other in the tractor support 8 and two lengths of pulley cable 64, one surrounding wheels 30 and 34 and one surrounding wheels 50 and 52. Each of the two lengths of pulley cable 64 is attached to one of the supports 18 and 20 by means of a turnbuckle 66, which is also used to adjust the tension of the pulley cable 64 around the pulley wheels. As an example of a typical pulley cable, 0.047" diameter wire may be used.

The pulley cables 64 may be tightened sufficiently by using the turnbuckles 66 so that the rotation of a pulley wheel moves a corresponding tractor support along its tractor shafts. However, the tension of the cables 64 is low enough so that when a tractor support reaches the end of the shaft and abuts upon a mounting block, further rotation of the pulley wheel will result in the slippage of the cable on the wheel but no further movement of the tractor support. This feature is particularly useful for verifying the alignment of the vertically spaced tractor supports, as will be described subsequently.

Figure 3:
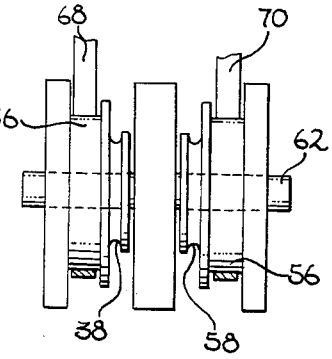
FIG. 3 is a plan view of the lower pulley arrangement of the present invention.

Pulley arrangements similar to those used to move the two upper tractor supports 18 and 20 are used to move the lower tractor supports 22 and 24. As may be seen more clearly in FIG. 3, they are comprised of two pulley wheels 40 and 60 which are rotatably mounted adjacent to each other in the lower left mounting block 10 on a pulley axle 62, two pulley wheels 38 and 58 which are rotatably mounted adjacent to each other in the lower right mounting block 12 on a pulley axle 62 and two lengths of pulley cable 64, one each surrounding wheels 38 and 40 and 58 and 60, respectively. The pulley cables 64 are coupled to tractor supports 22 and 24 by means of turnbuckles 66 which are used to adjust the tension of the pulley cables 64.

The present invention provides for simultaneous control of the position of the upper tractor supports 18 and 20 and the lower tractor supports 22 and 24 by means of a single control knob. This is accomplished by coupling the upper and lower pulley arrangements with an additional pulley arrangement. The pulleys 34 and 52 are integrally formed adjacent to two additional pulleys 32 and 54, respectively. Similarly, the pulleys 38 and 58 are formed integrally with pulleys 36 and 56, respectively. Of course, it should be recognized that the pulleys 32 and 34, 52 and 54, 36 and 38, and 56 and 58 need not be formed integrally; rather, they simply need to be scanned together so that they rotate in conjunction with one another. In addition, the pulley pair 36 and 38 is independently rotatable with respect to the pulley pair 56 and 58.

A pair of pulley belts 68 and 70 surround the pulleys 32 and 36 and 54 and 56, respectively. Rotation of the upper pulleys 32 and 54 will therefore impart rotation to the lower pulleys 36 and 56. The coupling between the upper and lower pulley arrangements facilitates simultaneous control of the position of the tractor supports 18, 20, 22 and 24. When the combined pulleys 32 and 34 are rotated, the tractor support 20 will be moved along the upper shafts 2*a* and 2*b* by means of a cable 64, and the combined pulleys 36 and 38 will be rotated by means of the belt 68. Rotation of the pulley 38 will move the tractor support 24 by means of a pulley cable 64. Thus, rotation of the combined pulleys 32 and 34 will result in simultaneous movement of the tractor supports 20 and 24. In a similar fashion, rotation of the combined pulleys 52 and 54 or 56 and 58 will cause simultaneous movement of the tractor supports 18 and 22 along their respective support shafts.

In order to accommodate paper forms of varying widths, it is necessary that the spacing between the tractor supports 18 and 20 and the spacing between the tractor supports 22 and 24 be adjustable. This is accomplished in the present embodiment by rotating only the rear pulley combination 32 and 34. This causes the tractor supports 20 and 24 to be moved along their respective shafts, while the tractor supports 18 and 22 remain stationary. In order to adjust the center position of a paper form, all four of the tractor supports 18, 20, 22 and 24 must be moved simultaneously either to the right or to the left. This is accomplished by rotating both the pulley combintion 32 and 34 and the pulley combination 52 and 54 in unison.

Figure 2:
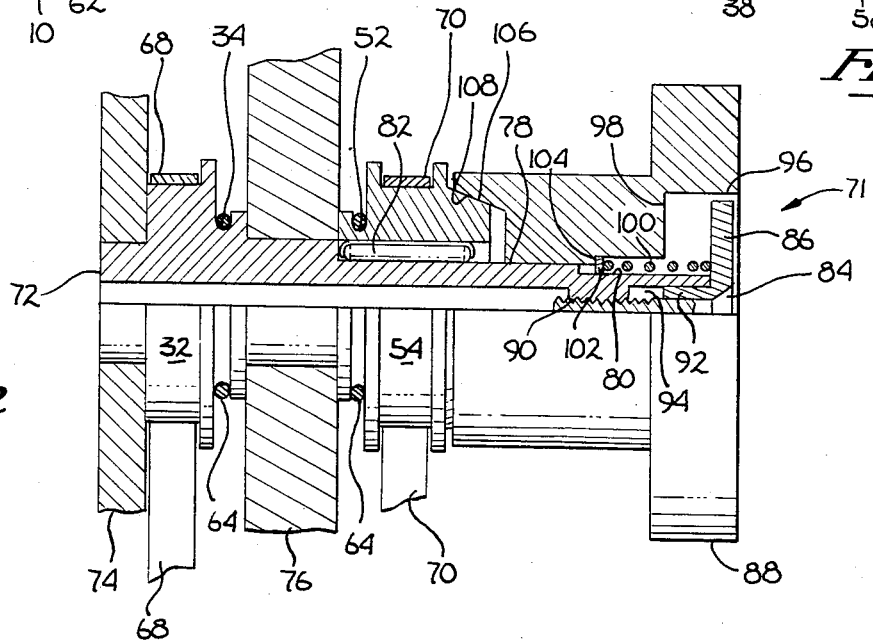
FIG. 2 is a plan view, partially in section, of the control knob of the present invention.

The control of the pulley arrangements to permit adjustment of the position of either the two tractor supports 20 and 24 or all four of the tractor supports 18, 20, 22 and 24 to provide paper form width or centering adjustment, respectively, is facilitated by a control knob 71. The control knob 71 is shown in detail in FIG. 2, and is mounted in the upper right mounting block 8. Two pulley wheels 38 and 58 which are rotatably mounted adjacent to each other in the lower right mounting block 12 on a pulley axle 62. The knob 71 is axially adjustable from a first position where rotation of the knob 71 will impart rotation only to the pulleys 32 and 34 to a second position where rotation of the knob 71 will also impart rotation to the pulleys 52 and 54.

The pulleys 32 and 34 are integrally formed with a main spindle 72 which is rotatably mounted within the mounting block 8. The pulleys 32 and 34 are located between two walls 74 and 76 of the mounting block 8. The spindle 72 includes an extension 78 having a reduced diameter end portion 80. A plurality of needle bearings 82 support the pulleys 52 and 54 for rotation with the extension 78. The pulleys 52 and 54 are separated from the pulleys 32 and 34 by means of the wall 76.

A control knob 88 is frictionally coupled into the extension 78. A retaining screw 84 fits within a threaded opening 90 and serves to hold a retaining disc 86 in position at the end of the extension 80. A sleeve 92 of the disc fits within an opening 94 of the extension 80. The disc 86 is located within an opening 96 in the knob 88. The opening 96 includes a shoulder 98. Normally, the knob 88 is biased into a position such that the retaining disc 86 does not contact the shoulder 98. This biasing is provided by a spring 100 located between the inner surface of the retaining disc 86 and a ring 102 located adjacent a shoulder 104 of knob 88. In the normal position, the biasing of the knob 88 causes a frusto-conial surface 106 of the knob to contact a frusto-conial surface 108 of the pulleys 52 and 54. The surfaces 106 and 108 provide a friction coupling between the knob 88 and the pulleys 52 and 54.

In its normal position, therefore, the knob 88 is frictionally coupled to the pulleys 52 and 54 as well as the pulleys 32 and 34. Rotation of the knob 88 will therefore cause movement of all of the tractor supports 18, 20, 22 and 24. In order to move only the tractor supports 20 and 24, the user simply pulls the knob 88 away from the pulleys 52 and 54. This causes the surface 106 to be moved away from the surface 108, thereby decoupling the knob 88 from the pulleys 52 and 54. The pulleys 32 and 34 will remain coupled to knob 88 by means of the friction fit with the extension 78. Therefore, by pulling out and rotating the knob 88, only the pulleys 32 and 34 will be rotated and only the tractor supports 20 and 24 will be moved. Thus, a simple friction clutch knob is used to provide single knob control for both spacing and centering of the tractor supports.

One of the advantages of this invention is the ability to verify the vertical alignment of the tractor supports on the upper and lower tractor shafts. This is readily accomplished by rotating the control knob 88 while in its first position until each of the tractor supports 18 and 22 on the left side come into contact with the two left side mounting blocks 6 and 10. If the two tractor supports 18 and 22 have fallen out of alignment, one of the tractor supports will contact its corresponding mounting block prior to the second tractor support contacting its corresponding mounting block. As the control knob 88 is turned further the second tractor support continues to approach the end of the tractor shaft and its mounting block, while the first tractor support remains at the end of the trctor shaft and its pulley cable slips on its respective cable pulley wheels. Once the tractor supports 18 and 22 both contact their corresponding mounting blocks 6 and 8, they are in vertical alignment. As previously stated, the correct cable tension to enable slippage over the pulley wheels is achieved by adjustment of the turnbuckle 66. The same procedure may be used to align the two tractor supports 20 and 24 on the other side of the device. After this is accomplished, the horizontal separation of the four tractor supports may be re-established with the control knob in its second or pulled out position.

Figure 4:
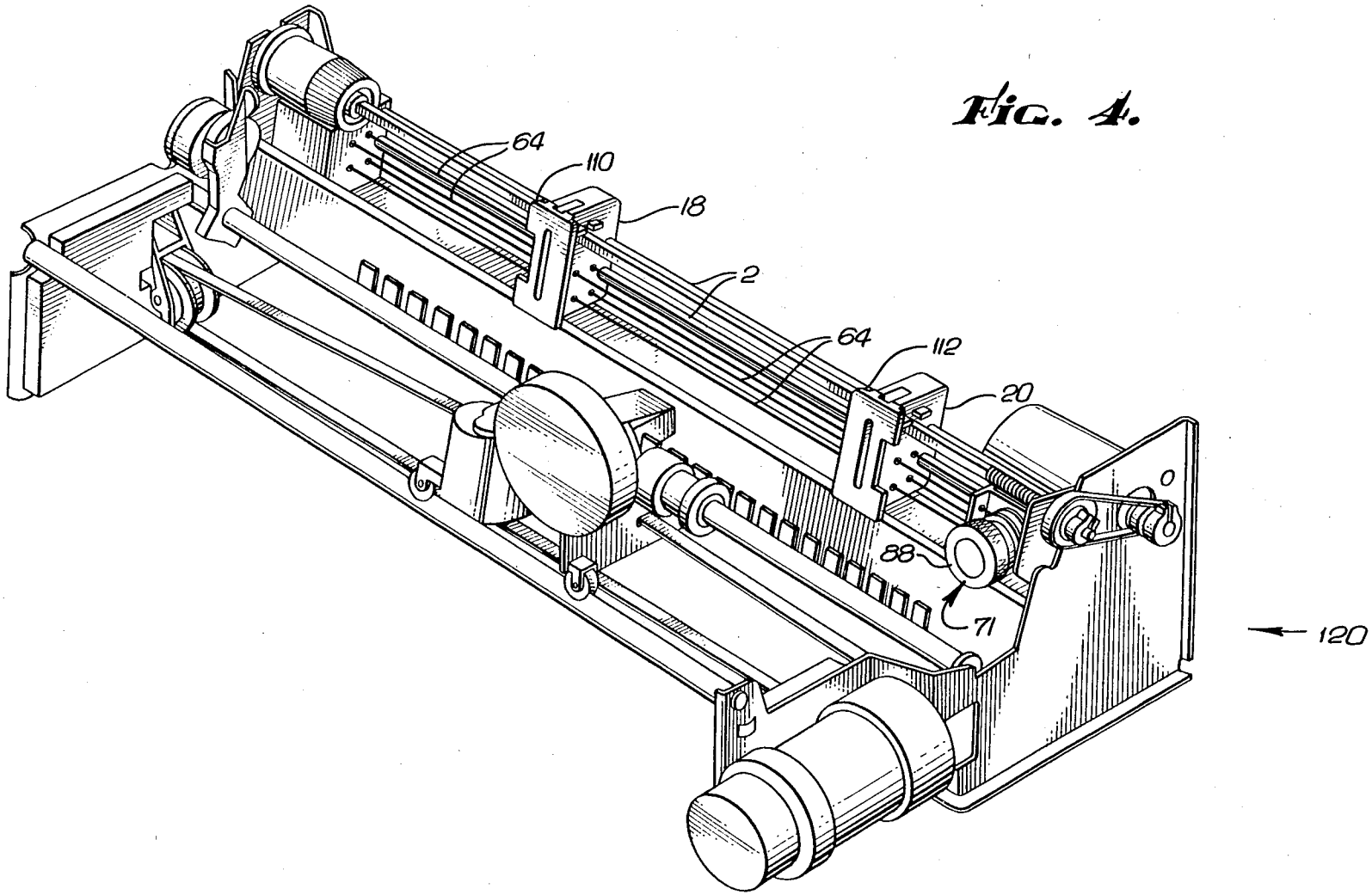
FIG. 4 is a perspective view of a printer utilizing the present invention.

FIG. 4 is a perspective view of a typical printer mechanism 120 with an assembly according to the present invention attached to it. The mechanism shown uses a single pair of tractor supports (18 and 20). Depending upon the design of the printer, either one or two pair of supports can be employed. Of course, if a single pair of supports is used, vertical alignment of tractor supports is not required. The tractor supports 18 and 20 support a pair of paper tractors 110 and 112, respectively. It should be noted that although a specific printer mechanism is shown, the inventive system can be incorporated into many various printer mechanisms by making slight modifications. The essential operation of the device is the same, regardless of the printer which is used.

In summary, the present invention provides for the adjustment of both the spacing and horizontal position of tractor supports in a printer assembly by means of a single control knob. In those printers which utilize at least two pair of tractors, the present invention also facilitates simple vertical alignment of the tractor supports. In addition, the invention has very low construction and maintenance costs. The system is easily attachable to a printer assembly and thus can be made as a separate subassembly. Although the present invention has been described in terms of a single embodiment, variations in modifications will readily occur to those skilled in the art, and it is therefore intended that the claims be interpreted to cover such modifications and equivalents.

We claim:

1. For use in a printer or the like, a device for horizontally positioning and maintaining tension on a paper form or the like, comprising:

a first horizontal support shaft;

a first tractor support movably mounted to the support shaft;

a second tractor support movably mounted to the support shaft;

first adjustment means for horizontally displacing the first tractor support;

second adjustment means for horizontally displacing the second tractor support;

control means for selectively controlling the first and second adjustment means so as to:

(a) move the first tractor support individually, or (b) move the first and second tractor supports in tandem;

a second horizontal support shaft spaced below the first support shaft;

a third tractor support movably mounted to the second support shaft below the first tractor support;

a fourth tractor support movably mounted to the second support shaft below the second tractor support;

third adjustment means for horizontally displacing the third tractor support;

fourth adjustment means for horizontally displacing the fourth tractor support;

a coupling mechanism connecting the first adjustment means with the third adjustment means and the second adjustment means with the fourth adjustment means, whereby the first tractor support will move in tandem with the third tractor support and the second tractor support will move in tandem with the fourth tractor support; and alignment means for vertically aligning and realigning the first and third tractor supports and the second and fourth tractor supports to the same horizontal positions, respectively, said alignment means including stop means, one located near each end of each support shaft and vertically aligned with the stop means at the corresponding end of the other support shaft, said stop means for abutting the tractor supports and halting their displacement along the support shafts, said adjustment means including means for enabling independent movement of the first tractor support with respect to the third tractor support and independent movement of the second tractor support with respect to the fourth tractor support despite the operation of the coupling mechanism, wherein the tractor supports are vertically aligned by displacing them to abut their corresponding stop means.

2. The device of claim 1 wherein:

said first and second adjustment means each comprises a pair of pulley wheels, one each rotatably secured to each end of the first support shaft and a cable looped around said pulley wheels, wherein the cable of the first adjustment means is connected to the first tractor support to control the movement thereof and the cable of the second adjustment means is connected to the second tractor support to control the movement thereof; and said third and fourth adjustment means each comprises a pair of pulley wheels, one each rotatably secured to each end of the second support shaft and a cable looped around said pulley wheels, wherein the cable of the third adjustment means is connected to the third tractor support to control the movement thereof and the cable of the fourth adjustment means is connected to the fourth tractor support to control the movement thereof.

3. The device of claim 2 wherein said control means comprises a single control knob for imparting rotation to one of the pulley wheels of each of the first and second adjustment means, said control knob being permanently coupled to the pulley wheel of the first adjustment means and selectively coupled to the pulley wheel of the second adjustment means.

4. The device of claim 3 wherein said control knob includes a friction clutch which normally directly couples the knob to the second adjustment means and wherein the knob is axially displaceable to move the clutch away from contact with the second adjustment means.

5. The device of claim 2 wherein each cable has free ends which are connected together to form a loop, said ends being connected by an adjustable turnbuckle, whereby the tension of the cables is adjustable, and wherein each turnbuckle is secured to a corresponding tractor support.

6. The device of claim 2 wherein the coupling mechanism comprises a first control pulley connected to a pulley of the first adjustment means, a second control pulley connected to a pulley of the third adjustment means, a cable looped around the first and second control pulleys, a third control pulley connected to one of the pulleys of the second adjustment means, a further control pulley connected to one of the pulleys of the fourth adjustment means and a cable looped around the third and fourth control pulleys.

7. The device of claim 5 wherein said alignment means comprises a first set of mounting blocks, one each secured to each end of the first support shaft and a second set of mounting blocks, one each secured to each end of the second support shaft directly below the first set of mounting blocks and wherein the tension of the cables is adjustable so that when a tractor support reaches the end of the support shaft and abuts upon a mounting block, further rotation of the pulley wheels will result in the slippage of the cables on the wheels but no further movement of the tractor support.

* * * * *